US005734356A

United States Patent [19]

Chang

[11] Patent Number: 5,734,356

[45] Date of Patent: Mar. 31, 1998

[54] CONSTRUCTION FOR PORTABLE DISK ANTENNA

[75] Inventor: Johnny Chang, Hsin-Chu, Taiwan

[73] Assignee: RF-Link Systems, Inc., Taiwan

[21] Appl. No.: 657,901

[22] Filed: Jun. 7, 1996

[51] Int. Cl.[6] ..... H01Q 3/02; H01Q 3/00

[52] U.S. Cl. ..... 343/882; 343/894; 343/760

[58] Field of Search ..... 343/882, 760, 343/757, 758, 894, 878, 880, 763, 761; 248/179, 183; H01Q 3/02, 3/00

[56] References Cited

U.S. PATENT DOCUMENTS 4,126,865 11/1978 Longhurst et al. ..... 343/894
4,689,635 8/1987 Haupt ..... 343/894

FOREIGN PATENT DOCUMENTS 59-37707 3/1984 Japan ..... 343/760

*Primary Examiner*—Hoanganh T. Le
*Attorney, Agent, or Firm*—Rabin, Champagne, & Lynt, P.C.

[57] ABSTRACT

This invention discloses an improved construction for portable disk antenna. This construction mainly comprises a disk antenna body, an outer member, an inner member, and a base. The outer member may rotate over 360 degrees about a first axis relative to the base. The inner member is rotably fitted into the outer member. The disk antenna body is connected to the inner member such that the disk antenna body, together with the inner member, can be rotated with respect to the outer member within an appropriate angular range about a second axis perpendicular to the first axis. This invention is characterized by further comprising an azimuth calibrating device having an azimuth calibration scale formed thereon for calibrating the azimuth deviation of the disk antenna body before use according to the indication of a compass; and an elevation calibrating device having an elevation scale formed thereon for calibrating the elevation deviation of the disk antenna body according to the indication of a level instrument. Consequently, the user can complete deviation calibration of the azimuth and the elevation of the disk antenna body by simple operation before use, and then directly adjust the azimuth and the elevation of the disk antenna body to correct values according to the operation manual for the portable disk antenna in order to readily receive the expected signals from the target artificial satellites.

6 Claims, 6 Drawing Sheets

Fig.4A
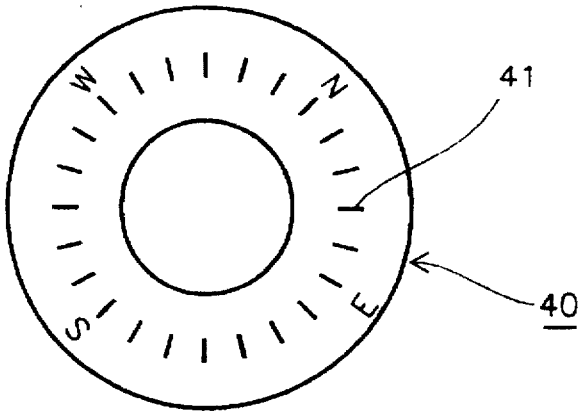
Fig.4B
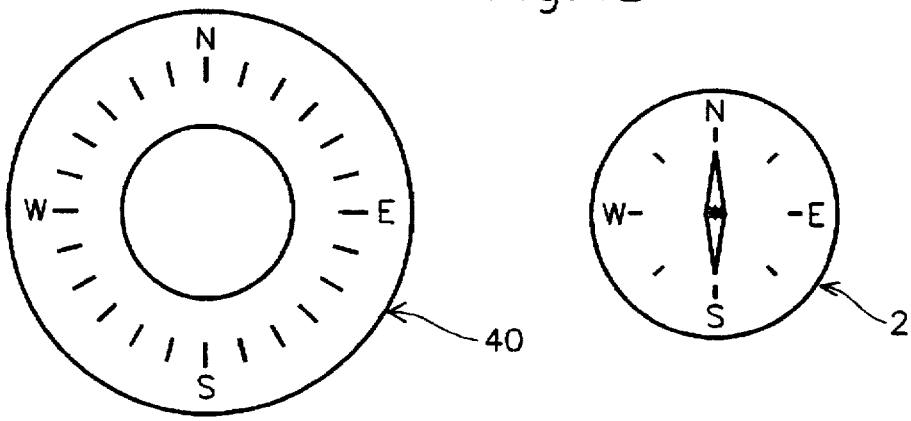
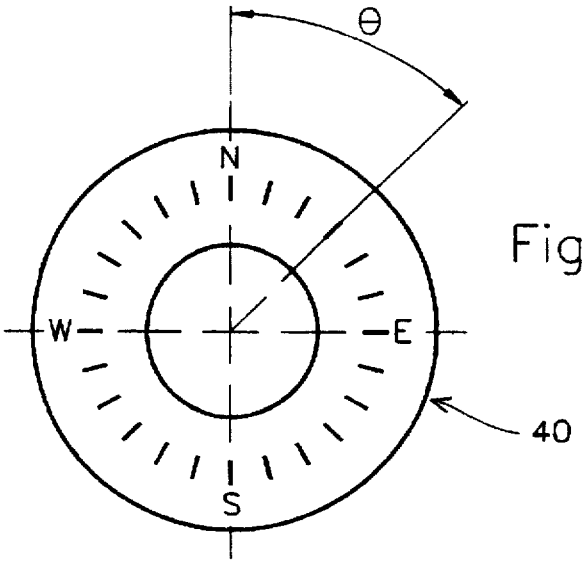
Fig.4C

CONSTRUCTION FOR PORTABLE DISK ANTENNA

BACKGROUND OF THE INVENTION

1. Field of the Invention

This invention relates to an improved construction for portable disk antenna and, more particularly, to an improved construction for portable disk antenna which is suitably used in the activities of searching for artificial satellites outdoors.

2. Technical Background

It is well known that, before using a portable disk antenna to search for an artificial satellite and then to receive its signal, the azimuth and elevation of the disk antenna must be adjusted to correct values first. However, various disadvantages reside in conventional portable disk antennas when used for such purpose. In some antennas, azimuth adjustment cannot be made after the antenna base is installed and fixed such that azimuth and elevation of the satellite signal source must be well located before the antenna base is fixed, which causes the reception angle tend to deviate. In some other cases, a disk antenna, of which the elevation adjustment has been finished, cannot steadily be stopped at a constant elevation, which causes its usage rather difficult.

In view of the above, an improved portable disk antenna for overcoming the aforementioned drawbacks of conventional portable disk antennas has been disclosed in a Taiwanese patent application (Ser. No. 82215720) entitled "A Base Construction for Portable Disk Antenna" (hereinafter refered to as the prior application), by which the azimuth and the elevation of an antenna can be further adjusted even after the antenna base has been installed and fixed.

However, the inventor of this invention found that the technical contents of the prior application still allow considerable improvement. Specifically, since the location for installing the portable disk antenna is usually not an absolutely horizontal plane and also the true direction for the "zero" azimuth reading of the portable disk antenna is unknown, it is impossible to adjust the azimuth and the elevation of the disk antenna directly according to an operation manual wherein the standard data of the azimuth (measured from the due north direction) and the elevation (measured from a horizontal plane) relating to some artificial satellites is listed, by use of the above-described antenna of the prior application. Instead, the deviations of the "zero" azimuth reading and the "zero" elevation reading, respectively, from the due north and the horizontal plane must be determined first by means of a compass and a level instrument. Subsequently, the correct values for the azimuth and the elevation of the target artificial satellites can be obtained by adding (subtracting) the deviation to (from) the standard data listed in the operation manual. Finally, the azimuth and the elevation of the disk antenna must be adjusted to the calculated values so as to locate the target artificial satellites. Such a task is not only timeconsuming but also laborious. Furthermore, not every user has sufficient ability to correctly carry out said calculation. The troublesomeness and inconvenience can be imagined for repeated calculations when signals from several different artificial satellites have to be received sequentially. Therefore, the portable disk antenna of the prior application is not an ideal design.

SUMMARY OF THE INVENTION

In view of this fact, it is an object of this invention to remove disadvantages of the portable disk antenna of the prior application and to provide a novel and advanced portable disk antenna by which, after correcting the deviation of the azimuth and the elevation of the disk antenna merely by using a compass and a level instrument, the user can directly adjust the azimuth and the elevation of the disk antenna to the standard data listed in an operation manual to locate a target artificial satellite without the necessity of any calculation. By use of the improved portable disk antenna of this invention, the target artificial satellite can be located much more easily and quickly in comparison with the above-described conventional disk antennas. In addition, once the disk antenna has been calibrated in its azimuth and elevation, it can be readily used to locate the second, the third and even more target artificial satellites by merely repeating the same adjustment task without the necessity of any further calibration or calculation.

According claim 1 of this invention, the improved construction for a portable disk antenna comprising:

a disk antenna body;

an antenna supporting frame for supporting the disk antenna body;

a base having a bottom surface which can be detachably installed at an appropriate position;

a hollow outer member generally in the shape of a hollow sphere with an elongate slot having an appropriate length being formed through the wall of the hollow sphere, the outer member being connected onto the base and being rotatable over 360 degrees with respect to the base about a first axis perpendicular to the bottom surface of the base;

an inner member rotably installed in the hollow sphere of the outer member;

a post having an upper end connected to the antenna supporting frame, and a lower end extending into the interior of the outer member through the elongate slot and being fixed to the inner member such that the disk antenna body can be rotated, together with the inner member, relative to the outer member within a proper angular range about a second axis passing through the center of the hollow sphere and perpendicular to the first axis;

characterized by further comprising:

an azimuth calibrating means including an annular portion which can be rotated with respect to the base and parallel to the bottom surface of the base, and an azimuth calibration scale formed on the annular portion, whereby an azimuth deviation of the disk antenna body can be calibrated before use according to the indication of a compass so as to enable a user to directly adjust the azimuth of the disk antenna body when in use; and an elevation calibrating means including a pivoting portion which is pivotably attached to the outer surface of the outer member and can be rotated about the second axis, and an elevation scale portion which is intergraly formed with the pivoting portion and has an elevation scale formed thereon, the elevation scale portion being able to rotate together with the pivoting portion along the elongate slot of the outer member for calibrating the elevation of the disk antenna body.

According claim 2 of this invention, the improved construction for portable disk antenna comprising:

a disk antenna body;

an antenna supporting frame for supporting the disk antenna body;

a base having a bottom surface which can be detachably installed at an appropriate position;

a hollow outer member which is generally in the shape of a hollow sphere with an elongate slot having an appropriate length being formed through the wall of the hollow sphere, and which is used for supporting the antenna supporting frame such that the disk antenna body can rotate, together with the antenna supporting frame, relative to the outer member over 360 degrees around a first axis passing through the center of the hollow sphere;

an inner member rotatably installed in the hollow sphere of the outer member;

a post having a lower end fixed to the base, and an upper end extending into the interior of the outer member through the elongate slot and being fixed to the inner member such that the outer member rotate relative to the base within a proper angular range about a second axis passing through the center of the hollow sphere and perpendicular to the first axis;

an elevation calibrating means including a pivoting portion which is pivotably attached to the outer surface of the outer member and can be rotated about the second axis, and an elevation scale portion which is intergraly formed with the pivoting portion and has an elevation scale formed thereon, the elevation scale portion being able to rotate together with the pivoting portion along the elongate slot of the outer member for calibrating the elevation of the disk antenna body; and an azimuth calibration device which is installed at an appropriate location on the outer surface of the outer member, and which has an azimuth calibration scale formed thereon, whereby an azimuth deviation of the disk antenna body can be calibrated before use according to the indication of a compass so as to enable a user to directly adjust the azimuth of the disk antenna body when in use According claim 3 of this invention, the improved construction for a portable disk antenna comprising:

a disk antenna body;

an antenna supporting frame for supporting the disk antenna body;

a frequency demultiplier;

a supporting arm having a first end fixed to the disk antenna body supporting frame, a second end for supporting the frequency demultiplier, and a bottom portion;

a base having a bottom surface which can be detachably installed at an appropriate position;

a hollow outer member which is generally in the shape of a hollow sphere with an elongate slot having an appropriate length being formed through the wall of the hollow sphere, and which is connected to the bottom portion such that the disk antenna body can rotate, together with the antenna supporting frame and the supporting arm, relative to the outer member over 360 degrees around a first axis passing through the center of the hollow sphere;

an inner member rotatably installed in the hollow sphere of the outer member;

a post having a lower end fixed to the base, and an upper end extending into the interior of the outer member through the elongate slot and being fixed to the inner member such that the outer member rotate relative to the base within a proper angular range about a second axis passing through the center of the hollow sphere and perpendicular to the first axis;

an elevation calibrating means including a pivoting portion which is pivotably attached to the outer surface of the outer member and can be rotated about the second axis, and an elevation scale portion which is intergraly formed with the pivoting portion and has an elevation scale formed thereon, the elevation scale portion being able to rotate together with the pivoting portion along the elongate slot of the outer member for calibrating the elevation of the disk antenna body; and an azimuth calibration device which is installed at an appropriate location on the outer surface of the outer member, and which has an azimuth calibration scale formed thereon, whereby an azimuth deviation of the disk antenna body can be calibrated before use according to the indication of a compass so as to enable a user to directly adjust the azimuth of the disk antenna body when in use.

According claims 4, 5 and 6 of this invention, the disk antenna body can be composed of at least two pieces which are separably connected.

BRIEF DESCRIPTION OF THE DRAWINGS

FIGS. 4A, 4B and 4C are schematic diagrams for illustrating the way for calibrating the azimuth of the disk antenna according to this invention;

DESCRIPTION OF THE PREFERRED EMBODIMENTS

Figure 1:
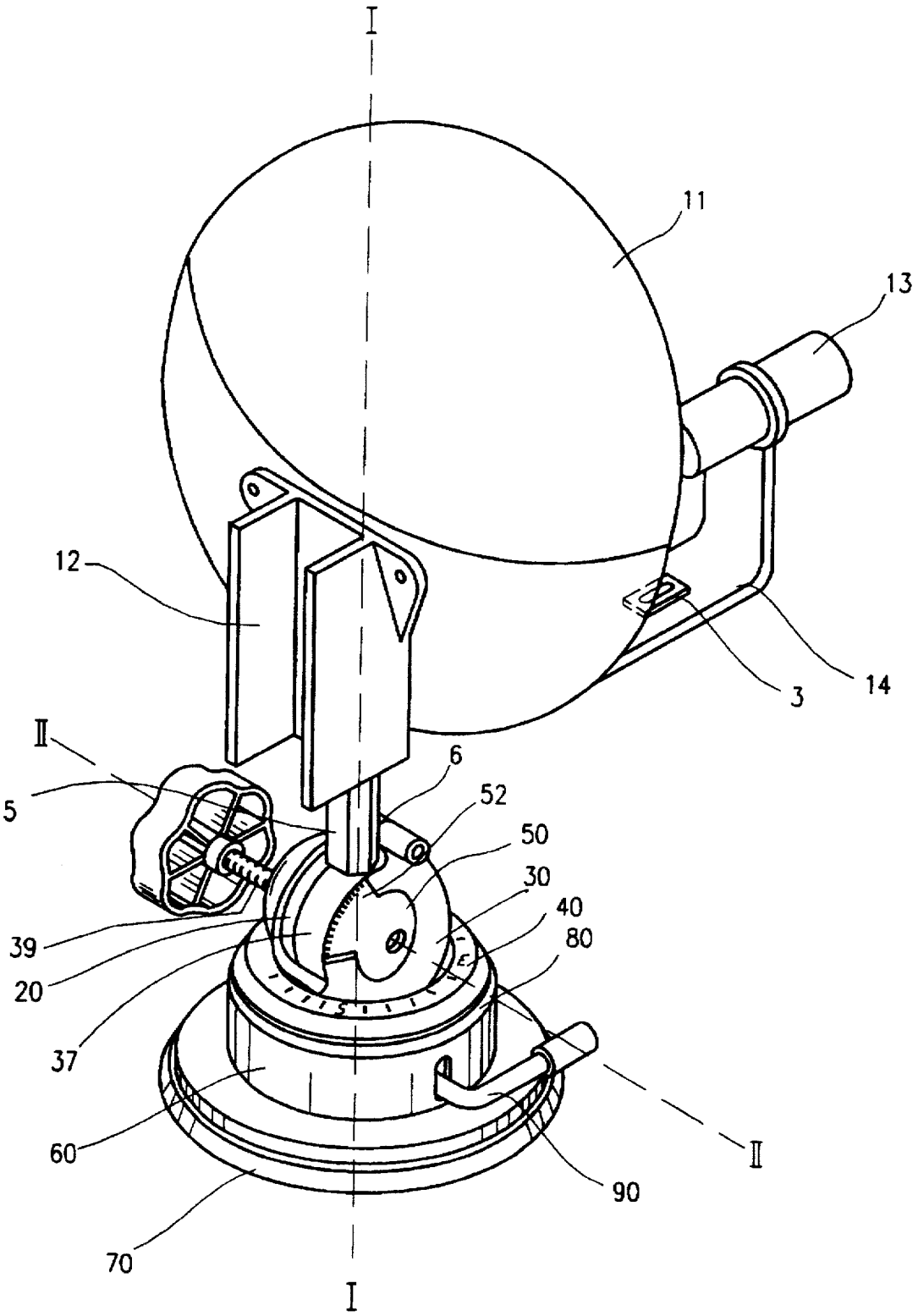
FIG. 1 is a perspective view of the improved construction of the portable disk antenna according to an embodiment of this invention.

As shown in FIG. 1, the portable disk antenna according to the first embodiment of this invention mainly comprises a disk antenna body 11, an antenna supporting frame 12, a frequency demultiplier 13, a supporting arm 14 for the frequency demultiplier 13, an outer member 30, an inner member 20, a lower member 60, a fixing ring 80, a suction cup 70, an azimuth calibration device 40, an elevation calibration member 50 and an operation rod 90. Among the above-described members, since the disk antenna body 11, the antenna supporting frame 12, the frequency demultiplier 13, and the supporting arm 14 of the frequency demultiplier 13, etc. are necessary elements for common portable disk antennas, the description concerning their function and construction is thus omitted.

Figure 2:
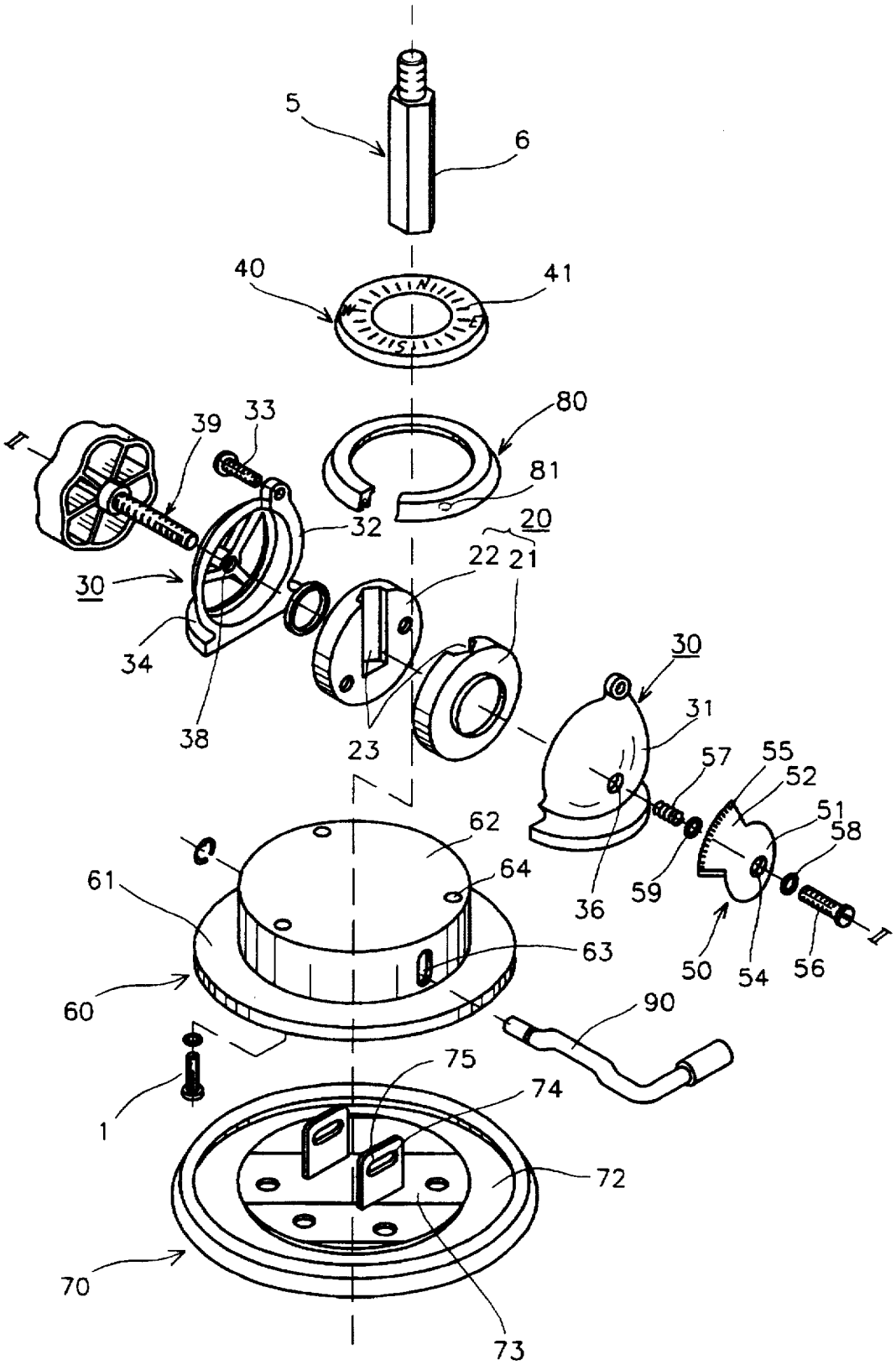
FIG. 2 is an exploded perspective view showing part of the portable disk antenna shown in FIG. 1.

FIG. 2 is an exploded perspective view showing part of the portable disk antenna shown in FIG. 1, in which the aforementioned disk antenna body 11, antenna supporting frame 12, frequency demultiplier 13 and supporting arm 14 are excluded. Now, with reference to FIG. 1 and FIG. 2, the construction of the portable disk antenna of this invention is described in detail.

First, construction of the portable disk antenna according to the aforementioned prior application (the Taiwanese Patent Application Ser. No. 82215720 entitled "A Base Construction for Portable Disk Antenna") is described. Then, improvements made in this invention with respect to the portable disk antenna of the prior application will be further described.

The construction of the suction cup 70 is described first. In the bottom of the suction cup 70 is provided with an air chamber (not shown) with an alterable volume, on which a flexible pressure-bearing plate 73 is fixed. Two vertical links 74, each having a through holes 75 formed through its thickness respectively, are attached to the pressure-bearing plate 73. An annular groove 72 is formed along the outer periphery of the suction cup 70.

Next, the construction of the lower member 60 is illustrated. The lower member 60, generally in the shape of a hat, comprises a flange portion 61 for being engaged into the annular groove 72 of the suction cup 70 such that the lower member 60 is fixed on the suction cup 70, and a cylindrical portion 62 having two elliptical holes 63 opened at radially opposite sides of its lateral surface and several through holes 64 formed on its top surface. The base of the disk antenna can be formed by engaging the flange portion 61 of the lower member 60 into the annular groove 72 of the suction cup 70. This base can be fixed on an appropriate smooth installation plane by inserting an operation rod 90 with eccentric portion through the elliptical holes 63 of the lower member 60 and the through holes 75 of the suction cup 70, and then rotating the operation rod 90 under a situation that the suction cup 70 is airtightly sticked to the installation plane so that the eccentric portion of the operation rod 90 will lift up the vertical links 74 and the plate 73, thus increasing the volume of the air chamber and reducing the pressure of the air chamber. Consequently, the base of the disk antenna will be sticked onto the installation plane by vacuum suction.

Next, the construction of the outer member 30 is described. This outer member 30 comprises a first semisphere 31 and a second semisphere 32, which abut against each other and are separably fastened together by a bolt 33 to form a generally spherical hollow structure. An elongate slot 37 is formed through the wall of the generally hollow sphere along the abutting line of the semispheres 31 and 32 (see FIG. 1). A semi-annular seat 34 is integrally formed at the lower end of each semisphere 31, 32. The outer member 30 is rotatably retained onto the base of the disk antenna by sandwiching the semi-annular seat 34 between a retaining ring 80 and the top surface of the lower member 60, and then fastening the retaining ring 80 to the lower member 60 (or the base of the disk antenna). The retaining ring 80 has several threaded holes 81 formed, respectively, at angular positions corresponding to those through holes 64 formed on the top surface of the lower member 60, and thus can be fastened to the lower member 60 by use of screws 1 ( only one is shown in FIG. 2). The outer member 30, installed as described above, may be rotated over 360° about a first axis I—I (refer to FIG. 1 ), which is perpendicular to the bottom plane of the base of the disk antenna and passes the spherical center of the outer member 30

Next, the construction of the inner member 20 is described. The inner member 20 is composed of a first member 21 and a second member 22, which abut against each other and are separably fastened together. This inner member 20 is received within the hollow spherical outer member 30 and can be rotated with respect to the outer member 30 about a second axis II—II (refer to FIGS. 1 and 2) which passes the spherical center of the outer member 30. When in fastened state, these two members 21 and 22 together form, at their abutting surfaces, a receiving hole 23 which extends in a direction perpendicular to the second axis II—II for firmly retaining a post 5 used for supporting the antenna supporting frame 12.

Next, a locking mechanism for the inner member 20 and the outer member 30 is described. When the two members 20 and 30 are adjusted to their expected positions, they may be locked by such a mechanism. A screw hole 38 parallel to the second axis line II—II is formed in the second semisphere 32 of the outer member 30. A screw rod 39 is threaded into the screw hole 38 and extends into the interior of the hollow spherical outer member 30. By tightly threading the screw rod 39, it will push the inner member 20 against the first semisphere 31 so as to hinder the inner member 20 from rotating about the second axis II—II with respect to the outer member 30. Meanwhile, due to the threading action of the screw rod 39, the second semisphere 32 will be moved away from the first semisphere 31 to make the seats 34 urge against the inner periphery of the retaining ring 80 and thus stop the outer member 30 from relative rotation with respect to the retaining ring 80 and the base of the disk antenna. Consequently, the inner member 20 and the outer member 30 are locked simultaneously when the screw rod 39 is tightly threaded. On the contrary, when the screw rod 39 is loosened, the inner member 20 and the outer member 30 may rotate freely about the second axis II—II and the first axis I—I, respectively.

The aforementioned relates to the construction of the disk antenna according to the prior application (Taiwanese Patent Application Ser. No. 82215720). The improvement made in this invention with respect to the prior application will now be described. The primary improvement is the further installation of the azimuth calibration device and the elevation calibration member.

The construction of the azimuth calibration device according to this invention is described first. As shown in FIGS. 1 and 2, the azimuth calibration device is composed of an azimuth calibration ring 40 superimposed on the retaining ring 80. An azimuth calibration scale 41 is formed on the surface of the azimuth calibration ring 40. This azimuth calibration ring 40 can be rotated freely with respect to the retaining ring 80 about the first axis I—I.

Next, referring to FIGS. 1 to 3, the construction of the elevation member according to this invention and the way of installing it will be described. As shown in the figures, this elevation calibration member 50 is mounted on the first semisphere 31 of the outer member 30. The elevation calibration member 50 comprises a pivoting portion 51 which is pivotably attached to the outer surface of the outer member 30 and can be rotated about the second axis II—II with respect to the member 30, and an elevation scale portion 52, with an elevation scale 55 formed thereon, which is intergraly formed with the pivoting portion 51. The elevation scale portion 52 can be rotated together with the pivoting portion 51 along the edge of the elongate slot 37 of the outer member 30 for calibrating the elevation of the disk antenna body.

Figure 3:
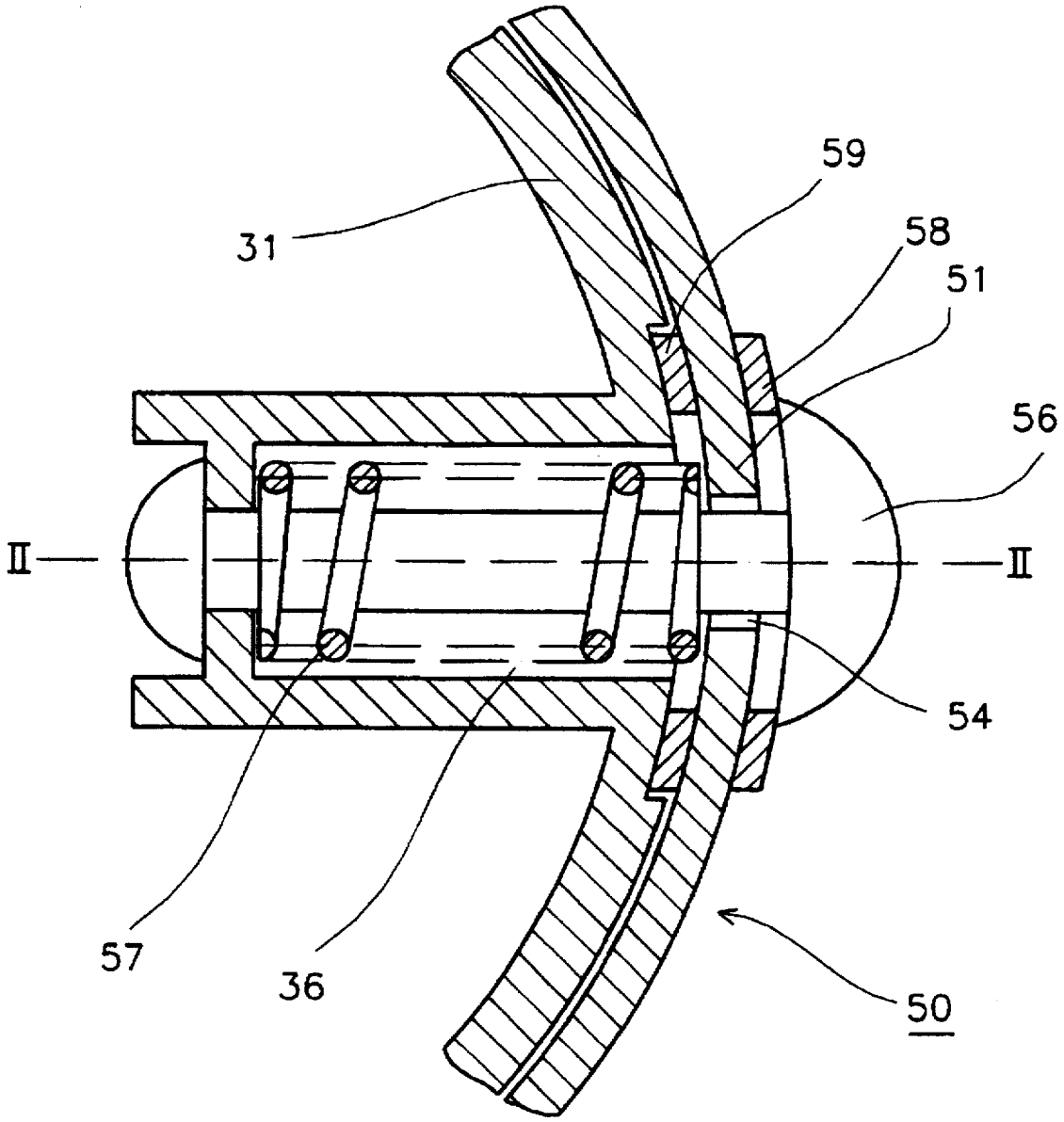
FIG. 3 is a partially sectional view showing a way for installing the elevation calibration member in the portable disk antenna according to this invention.

In FIGS. 2 and 3, an example of the way for mounting the elevation calibration member 50 onto the first semisphere 31 is shown. FIG. 2 is an exploded view, and FIG. 3 an assembly diagram. As can be seen from these two figures, two through holes 54 and 36 are provided, respectively, at the intersection of the pivoting portion 51 and the second axis II—II and at the intersection of the first semisphere 31 and the second axis II—II. The elevation calibration member 50 is rotatably mounted onto the first semisphere 31 by means of a fastening member (e.g. a rivet) 56 penetrating through these two through holes 54 and 36. In addition, a coil spring 57 is placed into a radial gap between the inner surface of the hole 36 and the fastening member 56 in a slightly compressed status with its two ends being urged against the inner surface of the pivoting portion 51 and the bottom of the hole 36 so that the elevation calibration member 50 may stop at any expected position after the member 50 has been properly rotated and adjusted. Furthermore, two plastic washers 58 and 59, respectively, are provided between the pivoting portion 51 and the head of the fastener 56 and between the pivoting portion 51 and the first semisphere 31, respectively, so as to avoid direct friction between metals.

FIGS. 4A, 4B and 4C are schematic views illustrating the way for adjusting the azimuth of a portable disk antenna according to this invention. FIG. 4A shows a state in which the direction indicated by the azimuth calibration ring 40 is arbitrary before its azimuth is calibrated. Next, calibrate the azimuth of the azimuth calibration ring 40 by rotating it according to the azimuth indication of a compass 2 in order to correct its azimuth deviation so as to make the azimuth of the ring 40 coincide with the indicated azimuth of the compass 2 as shown in FIG. 4B. The operation for calibrating the azimuth deviation of the azimuth calibration ring 40 before use is thus completed. Under this situation, according to the standard azimuth data θ for a specific artificial satellite provided, say, by the operation manual for the disk antenna, the user can directly adjust the azimuth of the disk antenna by rotating the outer member 30 to an angle θ read by the azimuth calibration ring 40 so as to readily locate the target artificial satellite.

Figure 5A:
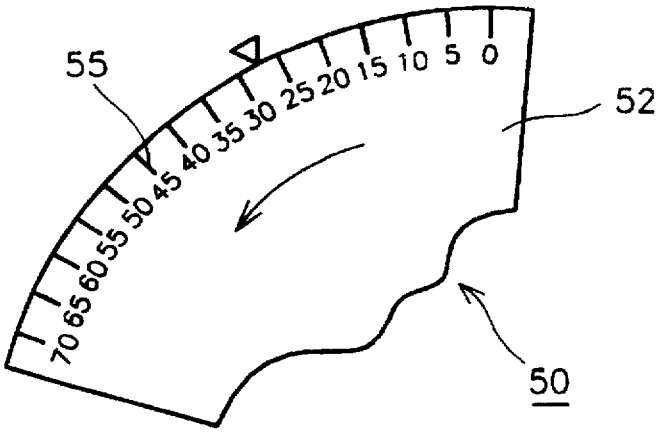
FIGS. 5A, 5B and 5C are schematic diagrams for illustrating the way for calibrating the elevation of the disk antenna according to this invention.
Figure 5B:
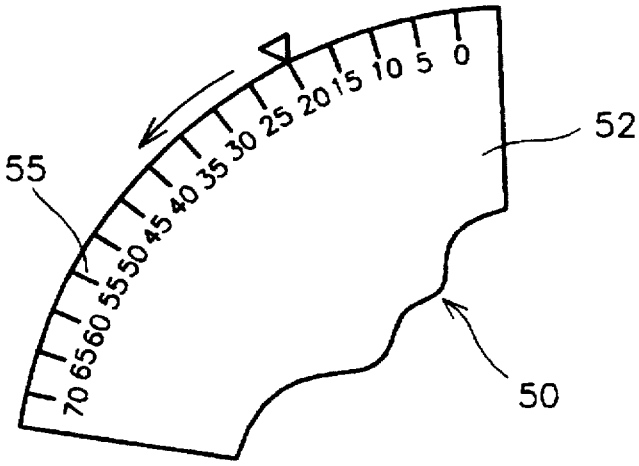
Figure 5C:
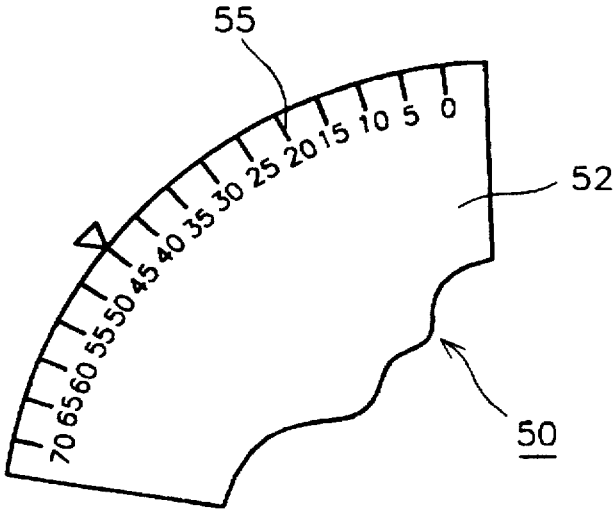

FIGS. 5A, 5B and 5C are schematic views illustrating the way for adjusting the elevation of the portable disk antenna according to this invention by means of the afore-described elevation calibration member. As a reference for indicating the elevation, the post 5 used for supporting the antenna supporting frame 12 may have a hexagonal cross-section so that one of its edge lines 6 (see FIGS. 1, 2) may be used as a reference mark for indicating the elevation. In FIGS. 5A to 5C, such a reference mark is represented by Δ. Referring to FIG. 1 and FIGS. 5A to 5C, upon rotating the disk antenna body 11 about the second axis II—II for adjusting the elevation of the disk antenna, the post 5 (i.e. the reference mark Δ) will rotate along the edge line of the scale portion 52 in the slot 37 of the outer member 30. Assume that the positional relationship between the mark Δ and the scale portion 52 of the member 50 is as shown in FIG. 5A when the supporting arm 14 of the frequency demultiplier 13 reaches a truely horizontal position which can be confirmed with the aid of a level instrument 3 placed on the arm 14. Provided that, according to the design of the disk antenna, accurate elevation indication can be obtained only if the mark Δ is in alignment with, say, the 20° reading of the scale portion 52 (see FIG. 5B) when the base of the disk antenna is mounted on a truely horizontal plane, the elevation calibration member 50 must first be adjusted to such a position so as to meet the above requirement. The operation for calibrating the elevation deviation of the elevation calibration member 50 before use is thus completed. Under this situation, according to the standard elevation data (e.g. 45°) for a specific artificial satellite provided, say, by the operation manual for the disk antenna, the user can directly adjust the elevation of the disk antenna by rotating the post 5, the inner member 20 together with the disk antenna body 11 to the 45° angle read by the scale portion 52 ( see FIG. 5C) so as to readily locate the target artificial satellite.

Figure 6C:
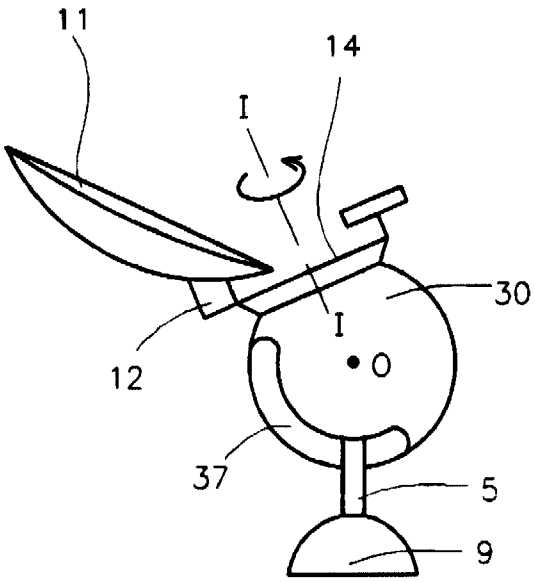
FIG. 6C is a schematic diagram of the portable disk antenna according to the third embodiment of this invention.
Figure 6B:
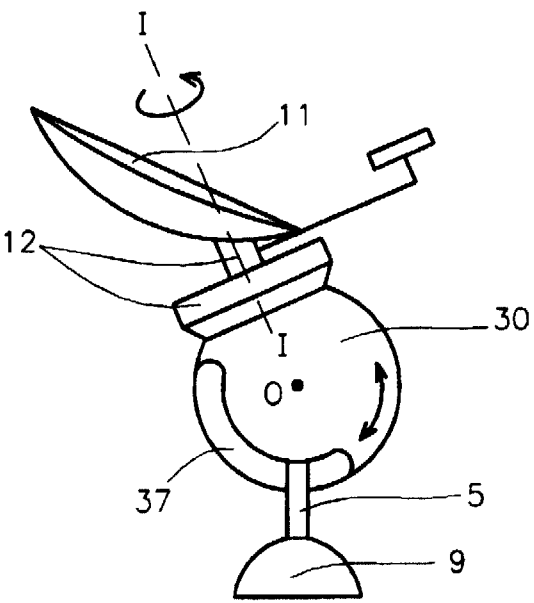
FIG. 6B is a schematic diagram of the portable disk antenna according to the second embodiment of this invention.
Figure 6A:
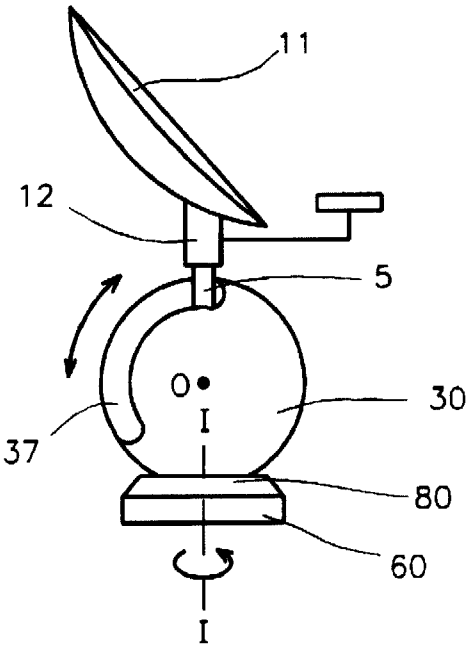
FIG. 6A is a schematic diagram of the portable disk antenna according to the first embodiment of this invention illustrated in FIG. 1.

FIG. 6A is a schematic diagram of the aforementioned portable disk antenna according to the first embodiment of this invention illustrated in FIG. 1. As described before, the outer member 30 may be rotated over 360° about the first axis I—I (also refer to FIG. 1) which is perpendicular to the base of the disk antenna and passes the spherical center 0 of the outer member 30. Besides, the disk antenna body 11 may be rotated within an appropriate angular scope about a second axis II—II (see FIGS. 1 and 2) which is orthogonal to the first axis I—I and passes the spherical center 0 of the outer member 30.

FIG. 6B is a schematic diagram showing a portable disk antenna according to the second embodiment of this invention which is obtained by slightly varying the aforementioned first embodiment of this invention. In this embodiment, the construction of the outer member 30 is the same as that of the first embodiment. This outer member 30 is rotatably connected to the bottom of the antenna supporting frame 12 so that the disk antenna 11 together with the frame 12 may be rotated over 360° with respect to the outer member 30 about the first axis line I—I passing through the spherical center 0 of the outer member 30 by means of the same rotation mechanism (not shown) as the first embodiment. An inner member is rotatably installed in said outer member 30. The post 5 used in this embodiment is slightly different from that in the first embodiment by comprising a lower end fixed to a base 9, and an upper end which extends through the elongate slot 37 into the interior of the hollow outer member 30 and is fixed to the inner member. Through the medium of the inner member and the post 5, the outer member 30 may be rotated within an appropriate angular scope with respect to the base 9 about the second axis line II—II which is orthogonal to the first axis I—I and passes the spherical center 0 of the hollow outer member 30. With such a construction, a function same as that of the first embodiment can be achieved.

FIG. 6C is a schematic diagram showing a portable disk antenna according to the third embodiment of this invention. The construction of this embodiment is basically as same as that of the second embodiment, the only difference resides in that the outer member 30 is rotatably connected to the bottom surface of the supporting arm 14 of the frequency demultiplier. Therefore, the disk antenna body 11 together with the supporting arm 14 may be rotated over 360° with respect to the outer member 30 about the first axis I—I passing through the spherical center 0 of the outer member 30, and the outer member 30, in turn, may be rotated within an appropriate angular scope with respect to the base 9 about the second axis line II—II. With such a construction, a function same as that of the first embodiment can be achieved.

In the second and the third embodiment, the way for installing the elevation calibration member is the same as that of the first embodiment, while the annular portion for the azimuth calibration must be properly installed at onto the surface of the outer member 30 in a plane orthogonal to the first axis I—I. In addition, when carrying out the calibration operation, the elevation should preferably be calibrated first to make the supporting arm 14 reach a truely horizontal position before performing azimuth calibration operation.

In conclusion, the portable disk antenna according to this invention can easily and readily locate the target artificial satellite, and thus timely receive the intended television program by further installation of the elevation calibration device and the azimuth calibration device. Besides, only once is required for calibrating the deviation of the azimuth and the elevation of the disk antenna at the same observation place. After finishing the calibration, the user can directly adjust the disk antenna to standard azimuth and elevation data listed in the operation manual for subsequent location of any other artificial satellites at the same observation place without the necessity of further calibration. Therefore, the practicability and manipulative convenience of the portable disk antenna of this invention is highly superior to other conventional portable disk antennas including the disk antenna as disclosed in the afore-mentioned prior application.

The above describes a few preferred embodiments of this invention, such embodiments are used to illustrate only and not to limit this invention. Various variations may be made and embodied without departing from the scope of the substantial contents of this invention, such variations will still belong to the scope of this invention. For instance, in the aforementioned embodiments, regarding the base of the disk antenna, although a suction cup type have been adopted, it is not limited to this type. Therefore, the scope of this invention is defined by the following appended claims.

I claim:

1. An improved construction for a portable disk antenna comprising:

a disk antenna body;

an antenna supporting frame for supporting said disk antenna body;

a base having a bottom surface which can be detachably installed at an appropriate position;

a hollow outer member generally in the shape of a hollow sphere with an elongate slot having an appropriate length being formed through the wall of said hollow sphere, said outer member being connected onto said base and being rotatable over 360 degrees with respect to said base about a first axis perpendicular to said bottom surface of said base;

an inner member rotably installed in said hollow sphere of said outer member;

a post having an upper end connected to said antenna supporting frame, and a lower end extending into the interior of said outer member through said elongate slot and being fixed to said inner member such that said disk antenna body can be rotated, together with said inner member, relative to said outer member within a proper angular range about a second axis passing through the center of said hollow sphere and perpendicular to said first axis;

characterized by further comprising:

an azimuth calibrating means including an annular portion which can be rotated with respect to said base and parallel to said bottom surface of said base, and an azimuth calibration scale formed on said annular portion, whereby an azimuth deviation of said disk antenna body can be calibrated before use according to the indication of a compass so as to enable a user to directly adjust the azimuth of the disk antenna body when in use; and an elevation calibrating means including a pivoting portion which is pivotably attached to the outer surface of said outer member and can be rotated about said second axis, and an elevation scale portion which is intergraly formed with said pivoting portion and has an elevation scale formed thereon, said elevation scale portion being able to rotate together with said pivoting portion along said elongate slot of said outer member for calibrating the elevation of said disk antenna body.

2. An improved construction for portable disk antenna comprising:

a disk antenna body;

an antenna supporting frame for supporting said disk antenna body;

a base having a bottom surface which can be detachably installed at an appropriate position;

a hollow outer member which is generally in the shape of a hollow sphere with an elongate slot having an appropriate length being formed through the wall of said hollow sphere, and which is used for supporting said antenna supporting frame such that said disk antenna body can rotate, together with said antenna supporting frame, relative to said outer member over 360 degrees around a first axis passing through the center of said hollow sphere;

an inner member rotatably installed in said hollow sphere of said outer member;

a post having a lower end fixed to said base, and an upper end extending into the interior of said outer member through said elongate slot and being fixed to said inner member such that said outer member rotate relative to said base within a proper angular range about a second axis passing through the center of said hollow sphere and perpendicular to said first axis;

an elevation calibrating means including a pivoting portion which is pivotably attached to the outer surface of said outer member and can be rotated about said second axis, and an elevation scale portion which is intergraly formed with said pivoting portion and has an elevation scale formed thereon, said elevation scale portion being able to rotate together with said pivoting portion along said elongate slot of said outer member for calibrating the elevation of said disk antenna body; and an azimuth calibration device which is installed at an appropriate location on the outer surface of said outer member, and which has an azimuth calibration scale formed thereon, whereby an azimuth deviation of said disk antenna body can be calibrated before use according to the indication of a compass so as to enable a user to directly adjust the azimuth of the disk antenna body when in use.

3. An improved construction for a portable disk antenna comprising:

a disk antenna body;

an antenna supporting frame for supporting said disk antenna body;

a frequency demultiplier;

a supporting arm having a first end fixed to said disk antenna body supporting frame, a second end for supporting said frequency demultiplier, and a bottom portion;

a base having a bottom surface which can be detachably installed at an appropriate position;

a hollow outer member which is generally in the shape of a hollow sphere with an elongate slot having an appropriate length being formed through the wall of said hollow sphere, and which is connected to the bottom portion such that said disk antenna body can rotate, together with said antenna supporting frame and said supporting arm, relative to said outer member over 360 degrees around a first axis passing through the center of said hollow sphere;

an inner member rotatably installed in said hollow sphere of said outer member;

a post having a lower end fixed to said base, and an upper end extending into the interior of said outer member through said elongate slot and being fixed to said inner member such that said outer member rotate relative to said base within a proper angular range about a second axis passing through the center of said hollow sphere and perpendicular to said first axis;

an elevation calibrating means including a pivoting portion which is pivotably attached to the outer surface of said outer member and can be rotated about said second axis, and an elevation scale portion which is intergraly formed with said pivoting portion and has an elevation scale formed thereon, said elevation scale portion being able to rotate together with said pivoting portion along said elongate slot of said outer member for calibrating the elevation of said disk antenna body; and an azimuth calibration device which is installed at an appropriate location on the outer surface of said outer member, and which has an azimuth calibration scale formed thereon, whereby an azimuth deviation of said disk antenna body can be calibrated before use according to the indication of a compass so as to enable a user to directly adjust the azimuth of the disk antenna body when in use.

4. An improved construction for the portable disk antenna as claimed in claim 1, wherein said disk antenna body is composed of at least two pieces which are separably connected.

5. An improved construction for the portable disk antenna as claimed in claim 2, wherein said disk antenna body is composed of at least two pieces which are separably connected.

6. An improved construction for the portable disk antenna as claimed in claim 3, wherein said disk antenna body is composed of at least two pieces which are separably connected.

* * * * *